US006885151B2

(12) United States Patent
Kim et al.

(10) Patent No.: US 6,885,151 B2
(45) Date of Patent: Apr. 26, 2005

(54) FLAT LAMP WITH HORIZONTAL FACING ELECTRODES

(75) Inventors: Gi-young Kim, Chungcheongbuk-do (KR); Hyoung-bin Park, Kyungki-do (KR); Seoung-jae Im, Seoul (KR); Ji-hyun Hong, Kyungki-do (KR); Yoon-jung Lee, Seoul (KR)

(73) Assignee: Samsung Electronics Co., Inc., Suwon-Si (KR)

( * ) Notice: Subject to any disclaimer, the term of this patent is extended or adjusted under 35 U.S.C. 154(b) by 173 days.

(21) Appl. No.: 10/347,456

(22) Filed: Jan. 21, 2003

(65) Prior Publication Data

US 2003/0137237 A1 Jul. 24, 2003

(30) Foreign Application Priority Data

Jan. 19, 2002 (KR) ..... 10-2002-0003193

(51) Int. Cl.[7] ..... H01J 17/04; H01J 1/62

(52) U.S. Cl. ..... 313/631; 313/484; 313/491; 313/631

(58) Field of Search ..... 313/582–583, 313/484, 491, 494–495, 621, 631, 243, 610

(56) References Cited

U.S. PATENT DOCUMENTS 4,336,535 A * 6/1982 Albertine, Jr. ..... 345/61
4,359,663 A * 11/1982 Shinoda et al. ..... 313/582
6,246,171 B1 * 6/2001 Vollkommer et al. ..... 313/586
6,441,554 B1 * 8/2002 Nam et al. ..... 315/111.21
6,628,066 B1 * 9/2003 Eberhardt et al. ..... 313/495

FOREIGN PATENT DOCUMENTS

JP 60044943 A * 3/1985 ..... H01J/11/00

OTHER PUBLICATIONS

Ilmer, M., et al., *Hg–free Flat Panel Light Source PLANON®—a Promising Candidate for Future LCD Backlights*, Society for Information Display International Symposium, Digest of Technical Papers 31, (2000), pp. 931–933.

Ikeda, Y., et al., *Mercury–Free, Simple–Structured Flat Discharge LCD Backlights Ranging from 0.5 to 5.2–in. Diagonals*, Society for Information Display International Symposium, Digest of Technical Papers 31, (2000), pp. 938–941.

Choi, J.Y., et al., *Mercury–Free, 18" class flat fluorescent Lamp with good uniformity*, Proceedings of the 1st International Display Manufacturing Conference, (2000), pp. 231–232.

* cited by examiner

*Primary Examiner*—Nimeshkumar D. Patel
*Assistant Examiner*—German Colón
(74) *Attorney, Agent, or Firm*—Burns, Doane, Swecker & Mathis, L.L.P.

(57) ABSTRACT

A flat lamp with horizontal facing electrodes is provided, in which a front substrate and a rear substrate are spaced such as to face each other. Walls between the front and rear substrates form a discharging space filled with a discharge gas. A plurality of front electrodes and a plurality of rear electrodes are provided on facing surfaces of the front and rear substrates, respectively. The front and rear electrodes, formed in strips, are arranged in such a way that the front electrodes alternate with the rear electrodes. Accordingly, the discharging distance between front and rear electrodes is lengthened, and many fine discharging operations occur between tip electrodes extending from the lateral sides of the electrode strips and flat portions of corresponding electrode strips. Therefore, a current concentration is prevented, thereby achieving uniform discharging. Also, brightness of the flat lamp increases.

13 Claims, 4 Drawing Sheets

FLAT LAMP WITH HORIZONTAL FACING ELECTRODES

BACKGROUND OF THE INVENTION

This application claims the priority of Korean Patent Application No. 2002-3193, filed on Jan. 19, 2002, in the Korean Intellectual Property Office, the disclosure of which is incorporated herein in its entirety by reference.

1. Field of the Invention

The present invention relates to a fiat lamp with horizontal facing electrodes, and more particularly, to a flat lamp with horizontal facing electrodes, in which electrodes are disposed on front and rear substrates in such a way that the electrodes on the front substrate do not face the electrodes on the rear substrate, and accordingly stable discharging occurs and brightness increases.

2. Description of the Related Art

Flat lamps for use as a backlight of a liquid crystal display (LCD) have been developed from conventional light-edging or light-directing cold cathode fluorescent lamps to surface discharging type or facing surfaces discharging type plasma lamps. The surface discharging type or facing surfaces discharging type plasma lamps are considered and developed in that the entire space under a light emitting diode serves as a discharging space in order to achieve luminous efficiency, the uniformity of luminescent brightness, or the like.

Surface discharging type plasma lamps generally provide more stable discharge characteristics than facing surfaces discharging type plasma lamps, but the brightness of the former lamps is lower than that of the latter lamps. In an example of a conventional surface discharging flat lamp (see M. Ilmer et al., Society for Information Display International Symposium, Digest of Technical Papers 31, 931 (2000)), an entire discharging area is divided into many fine discharging areas in order to prevent local concentration of discharge, and stable discharging can be performed. However, since the uniformity of the entire luminescent brightness is not good due to the difference in the luminescent brightness between fine discharging areas and the gap therebetween, this lamp must adopt a diffuser sheet to evenly diffuse light.

FIG. 1 shows another example of a conventional surface discharging flat lamp. A discharging space, which is filled with a discharge gas, is formed between front and rear substrates 1 and 2 spaced apart from each other by a wall 7. Discharging electrodes 3 and 4 are formed at both sides on the inner surface of the rear substrate 2 and each has a dielectric layer 5 formed thereon. A fluorescent layer 6 is formed on the inner surface of each of the front and rear substrates 1 and 2. It is known (see Y. Ikeda et al., Society for Information Display International Symposium, Digest of Technical Papers 31, 938 (2000)) that a surface discharging type flat lamp having such a structure provides low brightness according to the discharge characteristics.

FIG. 2 shows an example of a conventional facing surfaces discharging type flat lamp. A wall 7*a* isolates a front substrate 1*a* from a rear substrate 2*a* by a predetermined interval such that a discharging space is formed between the front and rear substrates 1*a* and 2*a*. Discharging electrodes 3*a* and 4*a* are formed on the outer surface of the front substrate 1*a* and the inner surface of the rear substrate 2*a*, respectively, such that the discharging electrodes 3*a* and 4*a* face each other. A dielectric layer 5*a* is formed on the electrode 4*a*, and a fluorescent layer 6*b* is formed on the electrode 4*a* and on the inner surface of the front substrate 1*a*. Such a facing surfaces discharging type flat lamp (see J. Y. Choi et al., Proceedings of the 1st International Display Manufacturing Conference, 231(2000)) provides a higher brightness than the surface discharging flat lamp of FIG. 1. However, this lamp has a low discharge efficiency due to excessive flowing of current and performs unstable discharging.

FIG. 3 shows another example of a conventional facing surfaces discharging type flat lamp. Electrodes 3*b* and 4*b* are formed on the inner surfaces of facing walls 7*b* so as to face each other. Each of the electrodes 3*b* and 4*b* is protected by a dielectric layer 5*b*. Also, the facing walls 7*b* separate the front and rear substrates 1*b* and 2*b* from each other such as to form a discharging space between the electrodes 3*b* and 4*b*. A fluorescent layer 6*b* is formed on each of the inner surfaces of the front and rear substrates 1*b* and 2*b*. A facing surfaces discharging type flat lamp having facing electrodes at a wall can prevent over-flowing of current, but is prone to have an unstable performance, and particularly, local discharging.

To sum up, conventional flat lamps provide low brightness if they perform stable discharging. Alternatively, if they have a high brightness, they suffer unstable discharging.

SUMMARY OF THE INVENTION

The invention provides a flat lamp with horizontal facing electrodes, which achieves stable discharging and has high brightness.

According to an embodiment of the present invention, there is provided a flat lamp with horizontal facing electrodes, in which a front substrate and a rear substrate are spaced to face each other. Walls between the front and rear substrates forms a discharging space filled with a discharge gas. A plurality of strip-like front electrodes and a plurality of strip-like rear electrodes are provided on facing surfaces of the front and rear substrates, respectively. Here, the front and rear electrodes are arranged alternately and in parallel.

Preferably, a plurality of tip electrodes are formed at predetermined intervals along both longitudinal sides of each of the front or rear electrodes in such a way that the tip electrodes at one longitudinal side alternate with the tip electrodes at the other longitudinal side.

It is also preferable that a plurality of tip electrodes are formed at predetermined intervals along both longitudinal sides of each of the front or rear electrodes in such a way that the tip electrodes of a front electrode alternate with the tip electrodes of an adjacent rear electrode.

According to another embodiment of the present invention, each of the electrodes has two unit electrodes disposed side by side.

According to still another embodiment of the present invention, each selected electrode between the front electrode and the rear electrode has two unit electrodes.

BRIEF DESCRIPTION OF THE DRAWINGS

The above features and advantages of the present invention will become more apparent by describing in detail exemplary embodiments thereof with reference to the attached drawings in which.

DETAILED DESCRIPTION OF THE INVENTION

Figure 1:
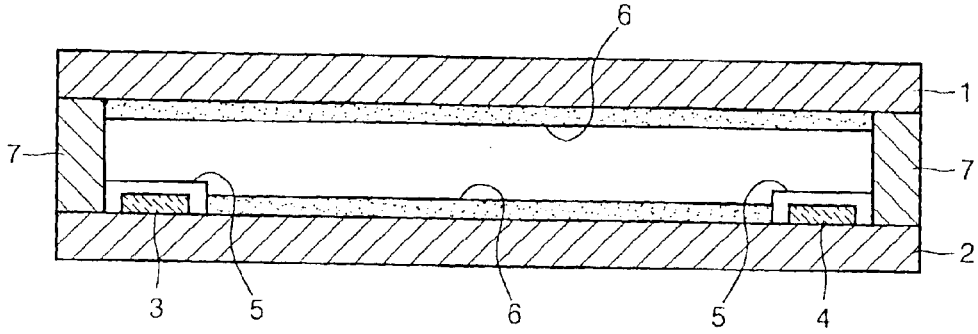
FIG. 1 (PRIOR ART)
FIG. 1 is a schematic cross-section of a conventional surface discharging type flat lamp.
Figure 2:
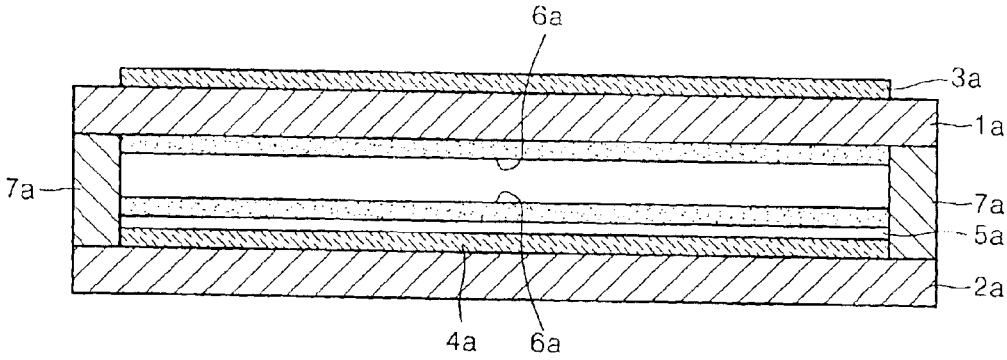
FIG. 2 (PRIOR ART)
FIG. 2 is a schematic cross-section of a conventional flat lamp with facing electrodes at front and rear substrates.
Figure 3:
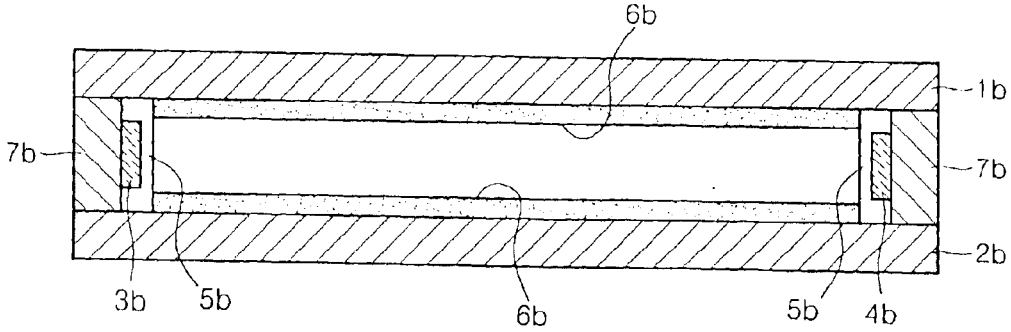
FIG. 3 (PRIOR ART)
FIG. 3 is a schematic cross-section of a conventional flat lamp with facing electrodes at walls.

The present invention will now be described more fully with reference to the accompanying drawings, in which preferred embodiments of the invention are shown. In the drawings, the thickness of layers or regions is exaggerated for clarity.

Figure 4:
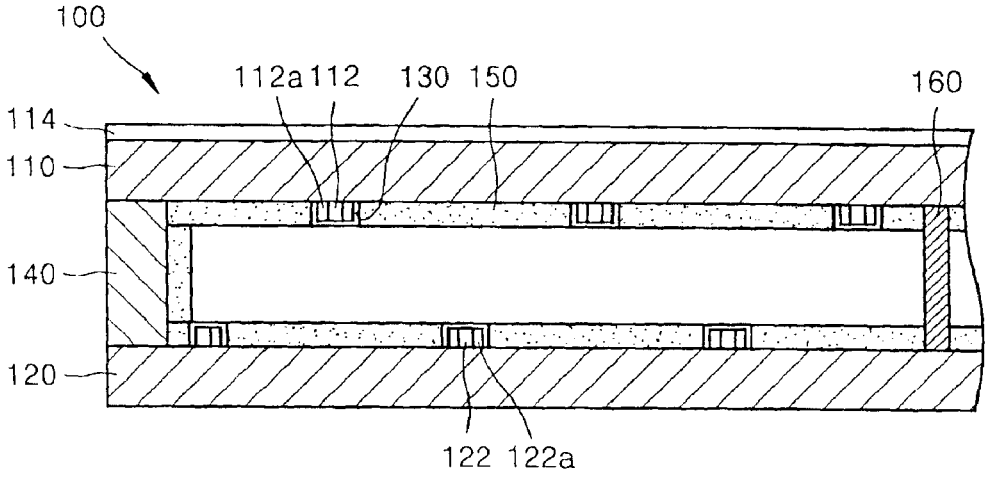
FIG. 4 is a partial cross-section of a flat lamp with horizontal facing electrodes according to a first embodiment of the present invention.
Figure 5:
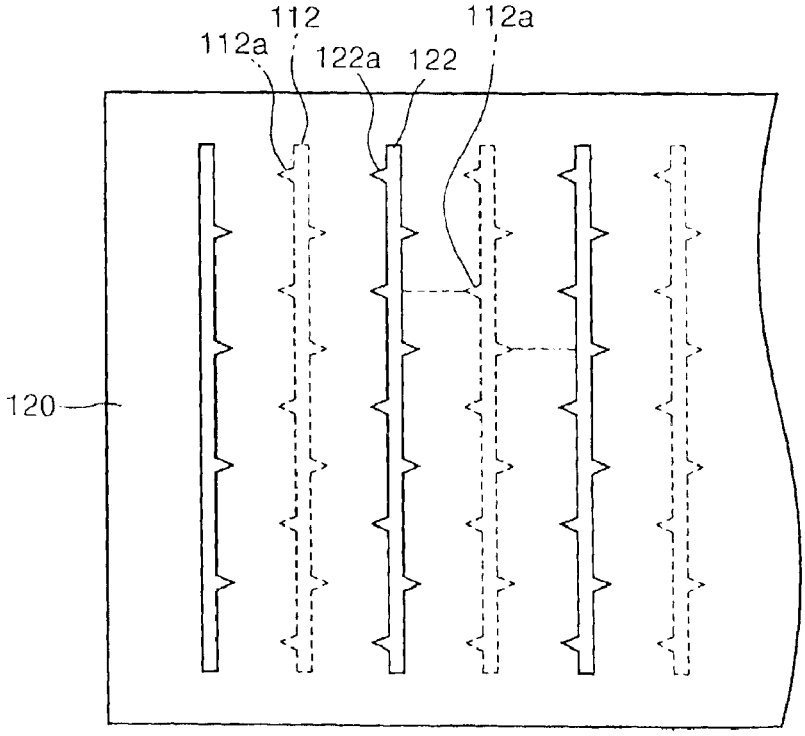
FIG. 5 is a perspective plan view schematically showing the arrangement of the electrodes of FIG. 4.

FIG. 4 is a partial cross-section of a flat lamp 100 with horizontal facing electrodes according to a first embodiment of the present invention. FIG. 5 is a perspective plan view schematically showing the arrangement of the electrodes of FIG. 4. In FIG. 5, dotted electrodes over a rear substrate 120 are electrodes disposed on a front substrate 110.

Referring to FIGS. 4 and 5, a discharging space, which is filled with a discharge gas, is formed between the front and rear substrates 110 and 120 which are isolated from each other by a wall 140. Electrodes 112 and 122 are formed in strips at predetermined intervals on the facing surfaces of the front and rear substrates 110 and 120, respectively, in such a way that the electrodes 112 alternate with the electrodes 122. Each of the front and rear electrodes 112 and 122 is protected by a dielectric layer 130, which prevents each of the front and rear electrodes 112 and 122 from contacting a discharge gas. The front electrodes 112 are made of transparent indium tin oxide (ITO). The front and rear electrodes 112 and 122 are connected to an external power source (not shown). A fluorescent layer 150 is formed on the inner surfaces of the front and rear substrates 110 and 120 and on the inner surface of the wall 140 and covers the dielectric layer 130. A reflective plate (not shown) may be interposed between the rear substrate 120 and the fluorescent layer 150 on the rear substrate 120. A plurality of spacers 160 stand between the front and rear substrates 110 and 120 so as to maintain a gap therebetween in order to prevent the flat lamp 100 from breaking due to a difference between inside and outside pressures of the flat lamp 100. A diffuser sheet 114, for preventing generation of a difference in luminescent brightness between fine discharging areas, may be further installed on the front substrate 110.

The front and rear electrodes 112 and 122, formed in strips, have a plurality of tip electrodes 112*a* and 122*a*, respectively. The tip electrodes 112*a* are arranged along both sides of the front electrode 112 in such a way that the tip electrodes on one side alternate with the tip electrodes on the other side, and likewise for the tip electrodes 122*a*. As shown in FIG. 5, the tip electrodes 112*a* and 122*a* are formed at the front and rear electrodes 112 and 122, respectively, in such a way that the tip electrodes 112*a* at a front electrode 112 alternate with the tip electrodes 112*a* at an adjacent rear electrode 122. In other words, a tip electrode 112*a* at a front electrode 112 is disposed to face and stably discharge with a nearest portion with no tip electrodes 122*a* of a rear electrode 122. The portion with no tip electrodes 122*a*, with which the tip electrode 112*a* discharges, is connected by a horizontal dashed line starting from the tip electrode 112*a* of FIG. 5.

A flat lamp according to the present invention operates according to a widely-known driving method. In a discharging space filled with a discharge gas, plasma discharging is generated and maintained by a voltage, e.g., an AC voltage, applied between electrodes 112 and 122. At this time, high temperature electrons for exciting neutral gas atoms and molecules are generated. Atoms and molecules excited by the high temperature electrons emit ultraviolet rays while returning to a normal state, and the emitted ultraviolet rays excite the fluorescent layer 150 coated within the discharging space and generate visible light. In order to prevent the front electrodes 112 formed on the front substrate 110 from being viewed by viewers, the front electrodes 112 and the dielectric layers 130 are formed of a material with high light transmittance, and the diffuser sheet 114 may be further installed on the front substrate 110.

A front electrode 112 on the front substrate 110 discharges together with two rear electrodes 122 on the rear substrate 120, which are associated with the front electrode 112 and are located under the front electrode 112. To be more specific, as shown by the two horizontal dashed lines of FIG. 5, a tip electrode 112*a* at one side of the front electrode 112 stably discharges with a nearest portion at the rear electrode 122 where a tip electrode 122*a* is not formed, in order to form a stable plasma discharge. A tip electrode 112*a* at the other side of the front electrode 112 generates stable discharging together with a nearest portion of a rear electrode 122 where a tip electrode 122*a* is not formed. Hence, many fine charging operations are performed by the tip electrodes 112*a* and 122*a*. Consequently, current concentration is prevented, discharging evenly occurs over the entire flat lamp, and brightness of the lamp increases.

The reflective plate (not shown) increases the brightness by reflecting descending light upward within the flat lamp 100.

In the first embodiment, tip electrodes are formed on both of the front and rear electrodes. However, in a modified embodiment, while a tip electrode is formed on a front electrode or a rear electrode, no tip electrodes are formed on a rear electrode corresponding to the front electrode or a front electrode corresponding to the rear electrode with a tip electrode. In the modified embodiment, a DC voltage is applied. In order to achieve a highly-efficient, stabilized discharging of flat lamps, preferably, a cathode is connected to the electrodes with tip electrodes, and an anode is connected to the electrodes with no tip electrodes. In another modified embodiment, tip electrodes are formed on neither the front electrodes nor the rear electrodes. In this modified embodiment, preferably, an AC voltage is applied to the front and rear electrodes as in the first embodiment of the present invention.

Figure 6:
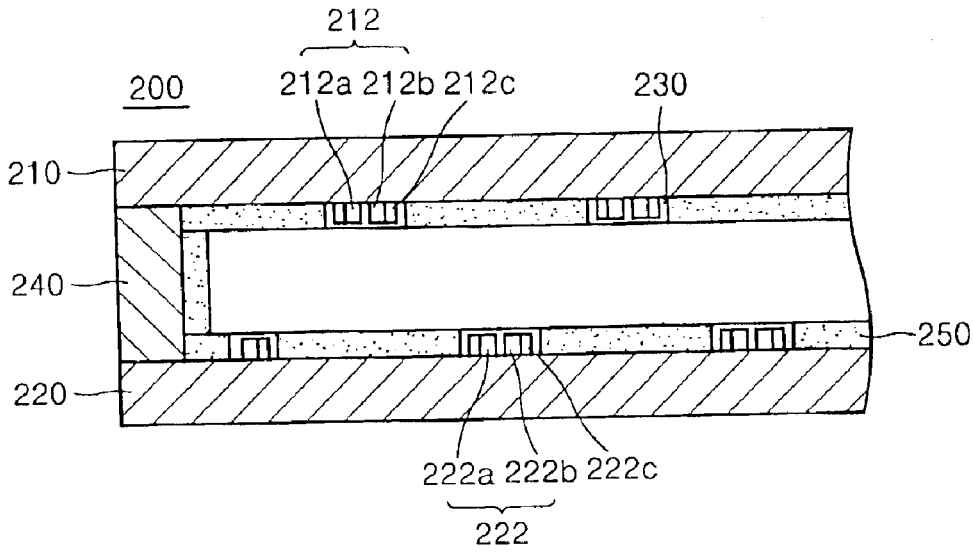
FIG. 6 is a partial cross-section of a flat lamp with horizontal facing electrodes according to a second embodiment of the present invention.
Figure 7:
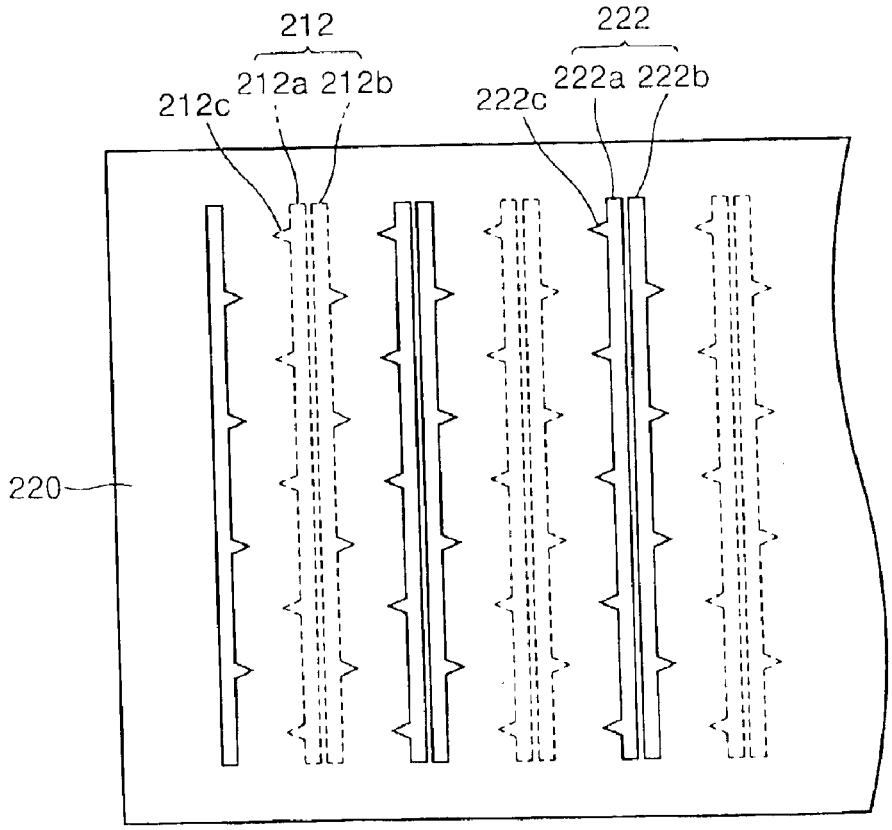
FIG. 7 is a perspective plan view schematically showing the arrangement of the electrodes of FIG. 6.

FIG. 6 is a partial cross-section of a flat lamp 200 with horizontal facing electrodes according to a second embodiment of the present invention. FIG. 7 is a perspective plan view schematically showing the arrangement of the discharging electrodes of FIG. 6. The same elements as those in the first embodiment will not be described in detail.

Referring to FIGS. 6 and 7, a discharging space filled with a discharge gas is formed between front and rear substrates 210 and 220 which are isolated from each other by a wall 240. Electrodes 212 and 222 are formed in strips at predetermined intervals on the facing surfaces of the front and rear substrates 210 and 220, respectively, in such a way that the electrodes 212 alternate with the electrodes 222. Each of the front electrodes 212 is composed of two unit electrodes 212*a* and 212*b* disposed side by side, and each of the rear electrodes 222 is composed of two unit electrodes 222*a* and 222*b* disposed side by side. Each of the unit electrodes 212*a*, 212*b*, 222*a*, and 222*b* is protected by a dielectric layer 230. A fluorescent layer 250 is formed on the inner surfaces of the front and rear substrates 210 and 220 and on the inner surface of the wall 240.

The unit electrodes 212*a* and 212*b*, formed in strips, have a plurality of tip electrodes 212*c* arranged at predetermined intervals along their outer sides. Likewise, the unit electrodes 222*a* and 222*b*, formed in strips, have a plurality of tip electrodes 222*c* arranged at predetermined intervals along their outer sides. The tip electrodes 212*c* and 222*c* are arranged at the front and rear electrodes 212 and 222, respectively, in such a way that the tip electrodes 212*c* of a front electrode 212 alternate with the tip electrodes 222*c* on an adjacent rear electrode 222.

When power is applied to the front and rear electrodes 212 and 222 of the flat lamp 200 having such a structure, either an electrode 212*a* or 212*b* of a front electrode 212 discharge together with the nearest unit electrode 222*a* or 222*b* of two rear electrodes 222 which are associated with the front electrode 212. To be more specific, a tip electrode 212*c* of the front electrode 212 performs stable plasma discharging together with a closest portion of an adjacent rear electrode 222 where a tip electrode 222*c* is not formed.

Figure 8:
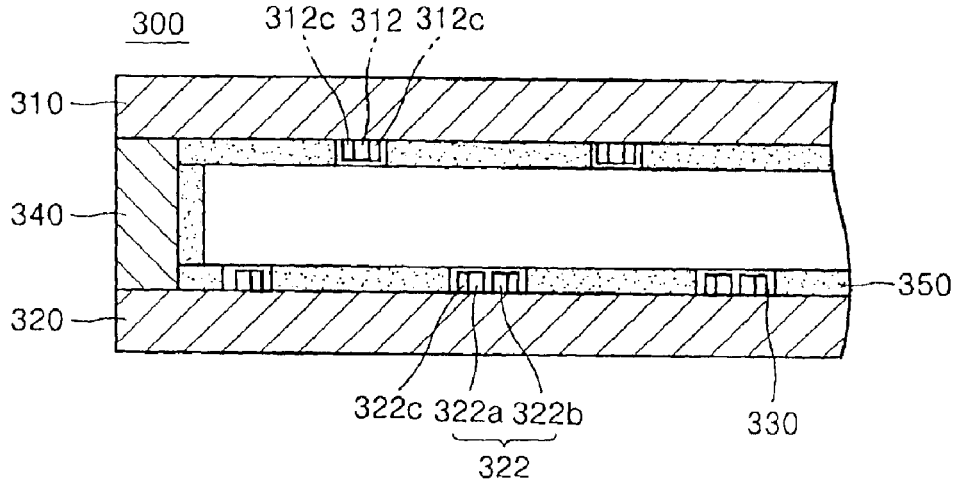
FIG. 8 is a partial cross-section of a flat lamp with horizontal facing electrodes according to a third embodiment of the present invention.
Figure 9:
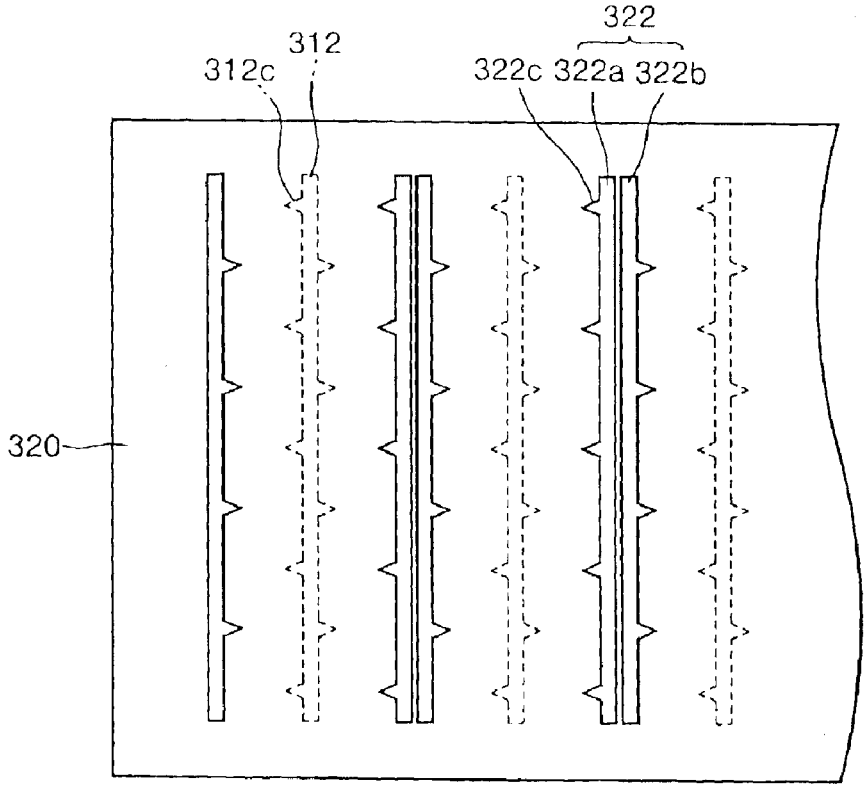
FIG. 9 is a perspective plan view schematically showing the arrangement of the electrodes of FIG. 8.

FIG. 8 is a partial cross-section of a flat lamp 300 with horizontal facing electrodes according to a third embodiment of the present invention. FIG. 9 is a perspective plan view schematically showing the arrangement of the discharging electrodes of FIG. 8. The same elements as those in the first and second embodiments will not be described in detail.

Referring to FIGS. 8 and 9, a discharging space filled with a discharge gas is formed between front and rear substrates 310 and 320 which are isolated from each other by a wall 340. Electrodes 312 are formed in strips at predetermined intervals on the inner surface of the front substrate 310, and electrodes 322, each of which is composed of two unit electrodes 322*a* and 322*b*, are formed in strips at predetermined intervals on the inner surface of the rear substrate 320. The front electrodes 312 alternate with the rear electrodes 322. Each of the front and rear electrodes 312 and 322 is protected by a dielectric layer 330. A fluorescent layer 350 is formed on the inner surfaces of the front and rear substrates 310 and 320 and on the inner surface of the wall 340.

The unit electrodes 322*a* and 322*b*, formed in strips, have a plurality of tip electrodes 322*c* arranged along their outer sides in such a way that the tip electrodes 322*c* of the unit electrode 322*a* alternate with those of the unit electrode 322*b*.

Also, the front electrodes 312, formed in strips, have a plurality of tip electrodes 312*c* arranged on their both sides. The tip electrodes 312*c* and 322*c* are arranged on the front and rear electrodes 312 and 322, respectively, in such a way that the tip electrodes 312*c* of a front electrode 312 alternate with the tip electrodes 322*c* at an adjacent rear electrode 322.

When power is applied to the front and rear electrodes 312 and 322 of the flat lamp 300 having such a structure, a front electrode 312 discharges with the unit electrodes 322*a* and 322*b* of two rear electrodes 322 which are associated with the front electrode 312. To be more specific, a tip electrode 312*c* of the front electrode 312 performs stable plasma discharging together with a closest portion of an adjacent rear electrode 322 where a tip electrode 322*c* is not formed.

As described above, a flat lamp with horizontal facing electrodes according to the present invention has discharging electrodes formed on two substrates in such a way that the electrodes on one substrate alternate with the electrodes on the other substrate. Accordingly, the discharging distance between front and rear electrodes is lengthened, and many fine discharging operations occur between tip electrodes extending from the lateral sides of the electrode strips and flat portions of corresponding electrode strips. Therefore, current concentration is prevented, and thus uniform discharging is achieved and brightness increases. Furthermore, stable discharging is achieved, and thus a large brightness area can be selectively obtained.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A flat lamp with horizontal facing electrodes, the flat lamp comprising:

a front substrate and a rear substrate which are spaced to face each other;

walls between the front and rear substrates to form a discharging space filled with a discharge gas; and a plurality of strip-like front electrodes and a plurality of strip-like rear electrodes which are provided on facing surfaces of the front and rear substrates, respectively, wherein the front electrodes and the rear electrodes are arranged alternately and in parallel, wherein each of the front and rear electrodes has a plurality of tip electrodes formed at predetermined intervals, and the tip electrodes of the front electrode alternate with the tip electrodes of the adjacent rear electrode.

2. The flat lamp with horizontal facing electrodes of claim 1, wherein the front or rear electrodes have a plurality of tip electrodes formed at predetermined intervals.

3. The flat lamp with horizontal facing electrodes of claim 2, wherein the tip electrodes are formed along longitudinal sides of the front or the rear electrode in such a way that tip electrodes at one longitudinal side alternate with tip electrodes at the other longitudinal side.

4. The flat lamp with horizontal facing electrodes of claim 1, wherein each of the electrodes has two unit electrodes disposed side by side.

5. The flat lamp with horizontal facing electrodes of claim 4, wherein a plurality of tip electrodes are formed at predetermined intervals at the outer longitudinal sides of the unit electrodes of the front or the rear electrode in such a way that the tip electrodes at one outer longitudinal side alternate with the tip electrodes at the other outer longitudinal side.

6. The flat lamp with horizontal facing electrodes of claim 1, wherein each selected electrode between the front electrode and the rear electrode has two unit electrodes.

7. The flat lamp with horizontal facing electrodes of claim 6, wherein a plurality of tip electrodes are formed at predetermined intervals at the outer longitudinal sides of the unit electrodes of the selected electrode in such a way that the tip electrodes at one unit electrode alternate with the tip electrodes at the other unit electrode.

8. The flat lamp with horizontal facing electrodes of claim 6, wherein a plurality of tip electrodes are formed at predetermined intervals on both longitudinal sides of a non-selected electrode in such a way that the tip electrodes at one side alternate with the tip electrodes at the other side.

9. The flat lamp with horizontal facing electrodes of claim 1, wherein a dielectric layer is formed over each of the electrodes.

10. The flat lamp with horizontal facing electrodes of claim 1, further comprising a reflective layer between the rear substrate and the rear electrodes.

11. A flat lamp with horizontal facing electrodes, the flat lamp comprising:

a front substrate and a rear substrate which are spaced to face each other;

walls between the front and rear substrates to form a discharging space filled with a discharge gas; and a plurality of strip-like front electrodes and a plurality of strip-like rear electrodes which are provided on facing surfaces of the front and rear substrates, respectively, wherein the front electrodes and the rear electrodes are arranged alternately and in parallel, and wherein the tip electrodes are formed along both longitudinal sides of the front and the rear electrode in such a way that the tip electrodes at one longitudinal side alternate with the tip electrodes at the other longitudinal side and that the tip electrodes of the front electrode alternate with the tip electrodes of the adjacent rear electrode.

12. A flat lamp with horizontal facing electrodes, the flat lamp comprising:

a front substrate and a rear substrate which are spaced to face each other;

walls between the front and rear substrates to form a discharging space filled with a discharge gas; and a plurality of strip-like front electrodes and a plurality of strip-like rear electrodes which are provided on facing surfaces of the front and rear substrates, respectively, wherein the front electrodes and the rear electrodes are arranged alternately and in parallel, wherein each of the electrodes has two unit electrodes disposed side by side, and wherein a plurality of tip electrodes are formed at predetermined intervals on the outer longitudinal sides of the unit electrodes of each of the front and the rear electrodes in such a way that the tip electrodes at one outer longitudinal side alternate with the tip electrodes at the other outer longitudinal side and that the tip electrodes at one side of each of the front electrodes alternate with the tip electrodes at a corresponding side of an adjacent rear electrode.

13. A flat lamp with horizontal facing electrodes, the flat lamp comprising:

a front substrate and a rear substrate which are spaced to face each other;

walls between the front and rear substrates to form a discharging space filled with a discharge gas; and a plurality of strip-like front electrodes and a plurality of strip-like rear electrodes which are provided on facing surfaces of the front and rear substrates, respectively, wherein the front electrodes and the rear electrodes are arranged alternately and in parallel, wherein each selected electrode between the front electrode and the rear electrode has two unit electrodes; and wherein a plurality of tip electrodes are formed at predetermined intervals at the outer longitudinal sides of the unit electrodes of the selected electrode so that the tip electrodes at one unit electrode alternate with the tip electrodes at the other unit electrode; a plurality of tip electrodes are formed at predetermined intervals on both sides of the non-selected electrode so that the tip electrodes at one side alternate with the tip electrodes at the other side; and the tip electrodes of each of the front electrodes alternate with the tip electrodes of an adjacent rear electrode.

* * * * *